US005857409A

United States Patent [19]

Derrickson

[11] Patent Number: 5,857,409

[45] Date of Patent: Jan. 12, 1999

[54] SYSTEM FOR MULTI-COLOR PRINTING WITH OBJECT REGISTRATION MEANS

[75] Inventor: Charles H. Derrickson, Chicago, Ill.

[73] Assignee: Dubuit of America, Inc., Niles, Ill.

[21] Appl. No.: 8,920

[22] Filed: Jan. 20, 1998

[51] Int. Cl.[6] ..... B41F 17/08

[52] U.S. Cl. ..... 101/38.1; 101/123

[58] Field of Search ..... 101/35, 38.1, 39, 101/40, 40.1, 114, 123, 124

[56] References Cited

U.S. PATENT DOCUMENTS

| | | | |
|---|---|---|---|
| 3,090,300 | 5/1963 | Dubuit | 101/123 |
| 4,109,573 | 8/1978 | Strauch et al. | 101/123 |
| 4,254,706 | 3/1981 | Lala | 101/38.1 |
| 4,282,806 | 8/1981 | Lala | 101/39 |
| 5,046,412 | 9/1991 | Dubuit et al. | 101/39 |
| 5,123,345 | 6/1992 | Wood | 101/124 |
| 5,339,732 | 8/1994 | Peterlini et al. | 101/38.1 |
| 5,524,535 | 6/1996 | Strutz et al. | 101/38.1 |
| 5,553,547 | 9/1996 | Miller | 101/485 |
| 5,651,308 | 7/1997 | Rohwetter et al. | 101/123 |

*Primary Examiner*—Ren Yan
*Attorney, Agent, or Firm*—Rudnick & Wolfe

[57] ABSTRACT

Semi-automatic screen printing equipment for multi-color printing of cylindrical objects wherein precise color-to-color registration may be achieved. A programmable color sensor, photoelectric system using fiber optics is preferably employed for reading a color image reflection from a rotating object and feeding a resulting signal into a pre-programmed color selector for providing an electrical signal to an electric clutch. The electric clutch engages a mechanical interlock drive between the screen printing plate and the object for precise color to color registered printing. A fixture is used for rotatably supporting an object to be printed. A screen and a squeegee for contacting the screen are used to force printing material through openings in the screen for application to the object surface. A first rotatable shaft is connected to the fixture, and a second rotatable shaft is provided. Clutch means connect these shafts for engaging and disengaging driving action therebetween. A first ratchet is mounted on the second shaft for rotation therewith, and a first pawl is located in a fixed position adjacent this shaft and is engageable with the first ratchet to restrict rotation of the second shaft in one direction while permitting rotation of the second shaft in the opposite direction. A second ratchet is mounted adjacent the second shaft, and a second pawl is mounted on the second shaft and is engageable with the second ratchet whereby rotation of this ratchet in the opposite direction operates to rotate the second shaft.

9 Claims, 9 Drawing Sheets

SYSTEM FOR MULTI-COLOR PRINTING WITH OBJECT REGISTRATION MEANS

BACKGROUND OF THE INVENTION

This invention relates to systems for printing of the type referred to as screen printing. In such systems, when printing cylindrical objects a screen is moved in linear motion synchronized with the surface of the rotating cylindrical object to be printed, and a squeegee establishes the contact between the screen and the surface. The object is sometimes rotated by friction or may be driven by a pulley and cable or a pinion and rack synchronized to the screen printing plate movement. Ink or the like is forced by the squeegee through openings in the screen onto the surface.

It is often desirable to print in several colors and this is accomplished by allowing the first color applied to dry and then applying one or more additional colors in successive printing and drying steps. To accomplish this in a satisfactory fashion, particularly where cylindrical objects are being printed, registration of the successive colors must be accomplished so that the overall multi-color effect will be achieved, and so that, in runs of several objects to be printed, each printed surface will appear the same on each object.

Various inks, epoxies, waxes, precious metals, ceramic colors, thermoplastic materials, etc., may be applied. Drying may be accomplished using air movement, heat, U.V. curing, thermoplastic inks, kilns, lehrs, etc.

The foregoing objects can be achieved using automatic machines wherein an object is held in a fixture and the fixture is moved through successive printing and drying stations without disturbing the position of the object in a fixture. Such automatic machines are expensive, however, and semi-automatic machines are more economical in many situations.

With the semi-automatic equipment, an object is placed in a fixture, a color is printed, the object is then removed for drying, and the object is then remounted in a fixture for printing of the next color. Certain objects, such as rectangular objects, do not present a problem as far as registration is concerned since they define distinct side edges which will serve as reference points to insure that the object is always placed in the same position in a fixture. Similarly, a cylindrical plastic object can be molded with an indent or the like which will provide a mating relationship with a fixture so that the object will always be mounted in the same position. Other distinctive parts of an object such as a handle, threaded area, or slot formed in an object can also be used as means for mechanically coupling the object in the fixture so that, with the fixture drive synchronized with the screen carriage movement, registration will be achieved.

Some objects, however, are truly symmetrical and do not have "built-in" reference points. These include glass and plastic drinking tumblers, wine glasses, open end dispensing tubes, wax candles and some medical items. For cosmetic and other reasons, it is also not desirable to form indentations and the like in the objects solely to provide a reference point for registration.

U.S. Pat. No. 5,553,547 includes a discussion of systems using a pointed indicator, such as a stylus, which is manipulated by an operator after a first color has been printed. The second and successive colors are printed after the indicator has been located at a predetermined reference point established by the first printing. The patent also discusses use of an infrared light source and detector to locate the reference point. Finally, the patent discloses a system wherein a laser beam generator and detector is employed which is stated to be less time consuming and more accurate than the other systems discussed.

SUMMARY OF THE INVENTION

The system of this invention comprises improvements in screen printing. In particular, the invention relates to printing using semi-automatic screen printing equipment for multi-color printing of cylindrical objects wherein precise color-to-color registration may be achieved. In a preferred form of the invention there is employed a programmable color sensor, photoelectric system using fiber optics to a sensor head for reading a color image reflection from a rotating object and feeding a resulting signal into a pre-programmed color selector for providing an electrical signal to an electric clutch. The electric clutch engages a mechanical interlock drive between the screen printing plate and the object for precise color to color registered printing. No preexisting printing or register mark is required to print the first color when using the mechanical drive interlock.

The system specifically comprises a fixture for rotatably supporting an object to be printed, a screen, means for moving the object and screen to achieve contact between the screen and the object surface, and a squeegee for contacting the screen to force printing material through openings in the screen for application to the object surface. A first rotatable shaft is connected to the fixture, and a second rotatable shaft is provided. Clutch means connect these shafts for engaging and disengaging driving action therebetween. A first ratchet is mounted on the second shaft for rotation therewith, and a first pawl is located in a fixed position adjacent this shaft and is engageable with the first ratchet to restrict rotation of the second shaft in one direction while permitting rotation of the second shaft in the opposite direction. A second ratchet is mounted adjacent the second shaft, and a second pawl is mounted on the second shaft and is engageable with the second ratchet whereby rotation of this ratchet in the opposite direction operates to rotate the second shaft. Means are provided for detecting a registration mark, preferably a color-sensitive means, on the object to be printed, and means are also provided for engaging the clutch means in response to detection of a registration mark.

DESCRIPTION OF THE DRAWING FIGURES

Figure 11:
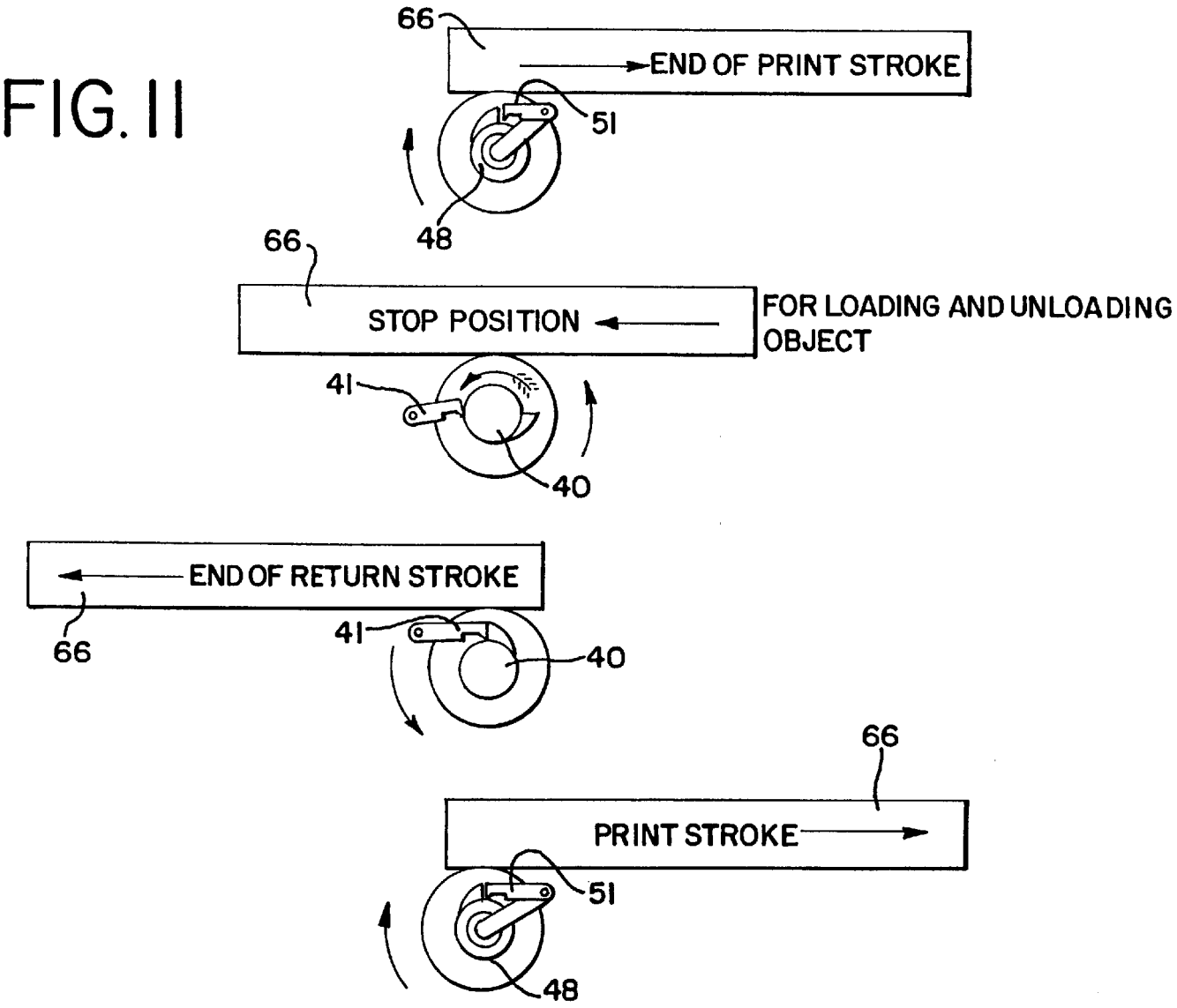
Figure 12:
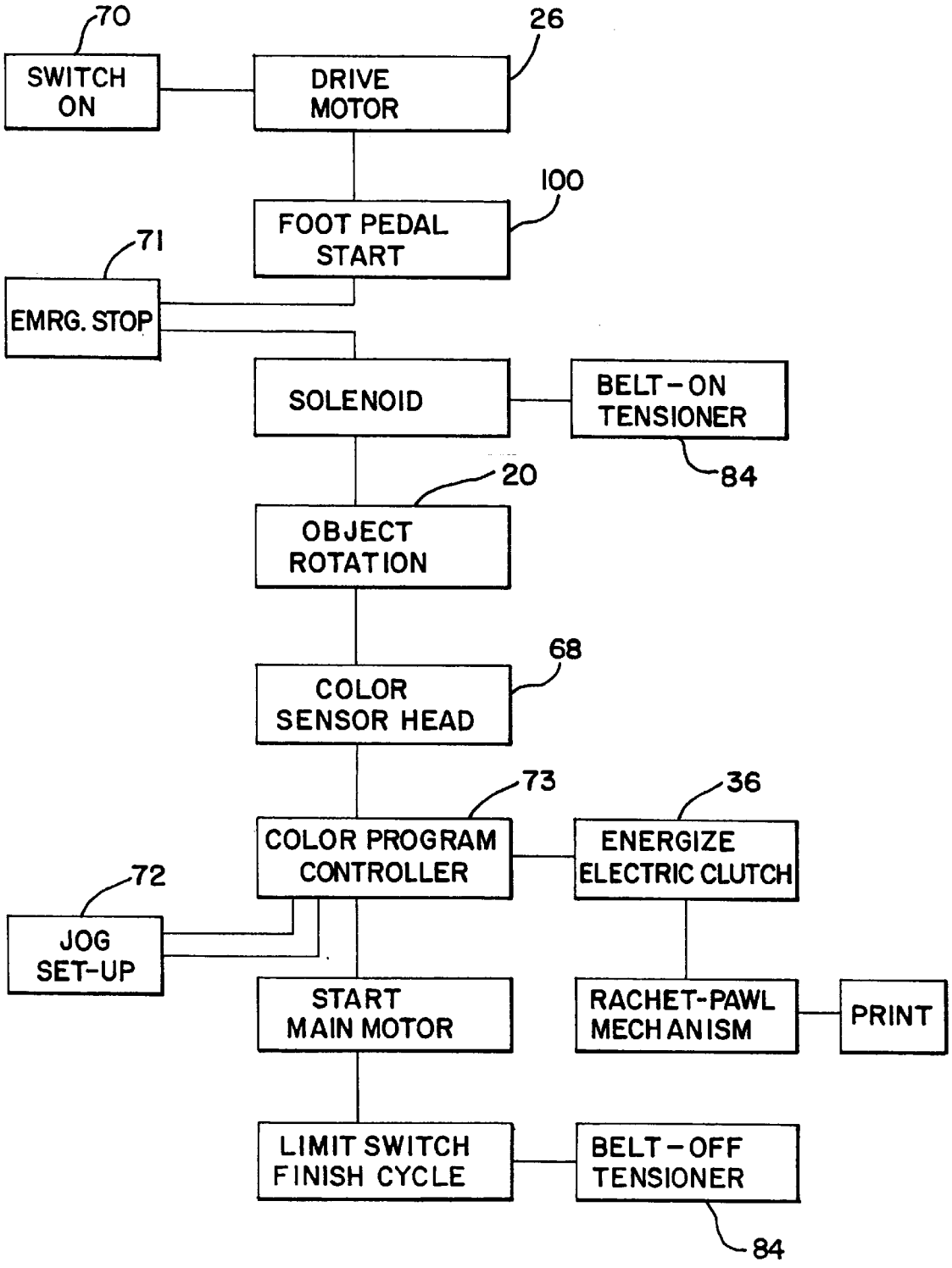

FIG. 11 schematically illustrates a preferred sequence of operating steps; and FIG. 12 is a diagrammatic illustration of a preferred control circuit.

DETAILED DESCRIPTION OF THE PREFERRED EMBODIMENTS

Figure 1:
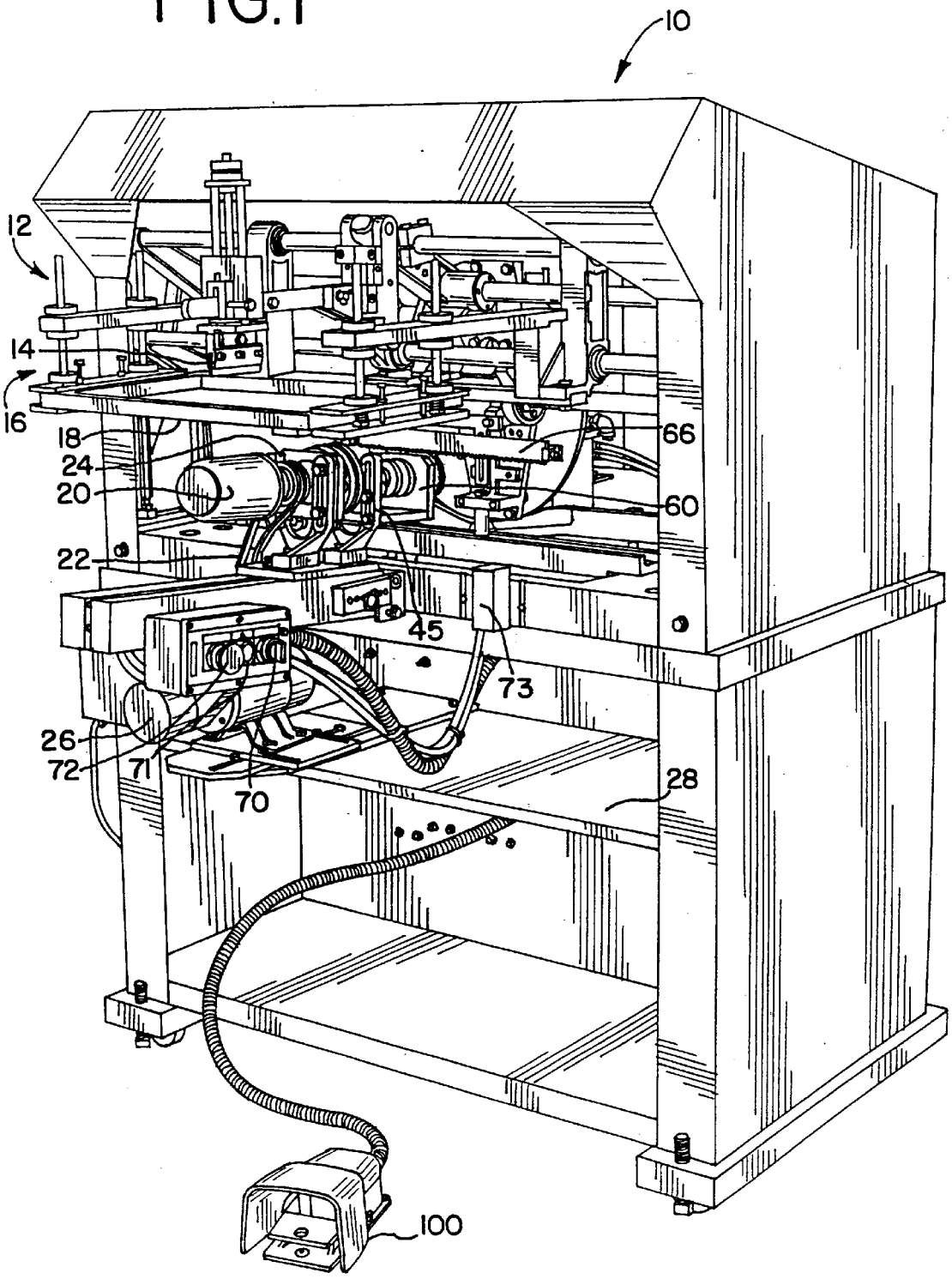
FIG. 1 is a front elevational perspective view of a semi-automatic silk screen printing machine adapted for operation in accordance with this invention.

FIG. 1 illustrates a semi-automatic screen printing machine 10. This machine includes many components of existing products such as Model No. D150 marketed by Dubuit of America, Inc., applicant's assignee. This type of machine includes a squeegee assembly 12 supporting squeegee 14. A silk screen assembly 16 is provided for supporting silk screen frame 18 in position beneath the squeegee.

The object 20 which is to have the printing ink applied thereto, is supported beneath the screen frame. In accordance with the known operation of this machine, the screen is lowered into position adjacent the surface of the object, and the squeegee is likewise lowered into contact with the screen. The object 20 is supported for rotation and, as the screen is driven laterally in timed relation with the object surface, ink is applied to the surface.

The object is rotated by means of belt 22 which drives pulley 24. Drive motor 26 is supported on shelf 28 for achieving this driving action. For purposes of this description, it will be assumed that the driving movement first imparted by motor 26 is in the counter-clockwise direction when facing the machine 10 but it will be understood that the components to be described are adapted for initial clockwise rotation if that were preferred.

Figure 4:
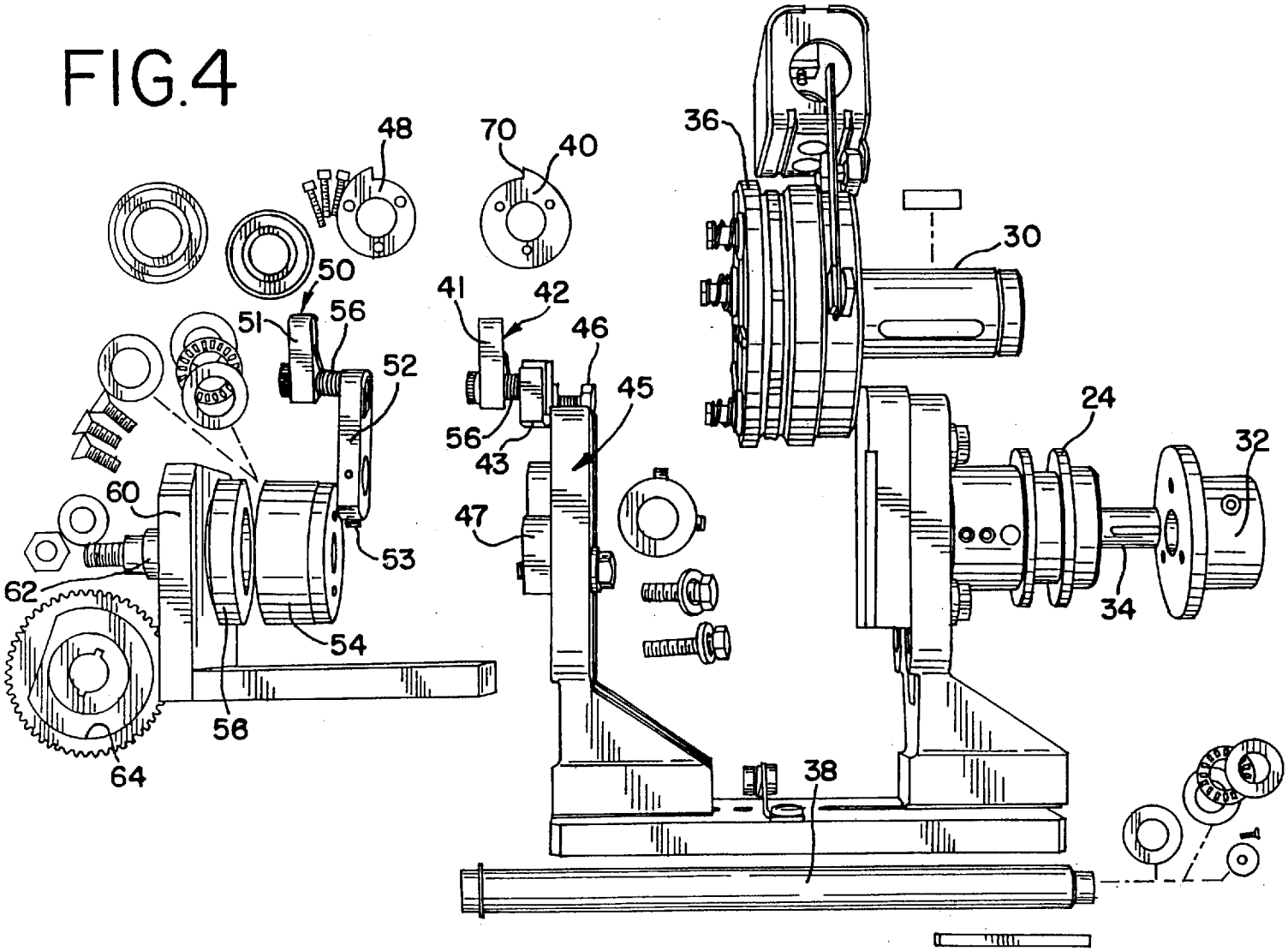
FIG. 4 is an exploded view illustrating the component parts of the drive system used in the practice of the invention.

FIG. 4 also illustrates an adapter 32 of a type used for securing the object 20 in position. It will be appreciated that various fixtures known in the art may be used for this purpose depending, for example, on whether the object has a straight wall or is tapered, and on factors such as the object material and size. The object may be placed on a mandrel or held between centers, and vacuum, magnetic or other holding systems could be used.

The pulley 24 is supported on a shaft 34 which extends within and is tied to clutch shaft 30 of an electromagnetic clutch 36. Shaft 38 extends rearwardly of the clutch and a first ratchet 40 is fixed to this shaft. First pawl assembly 42 comprising pawl 41 and support arm 43 is engageable by ratchet 40 and the support arm is mounted on an upstanding arm 44 of yoke 45 by means of bolt 46. The yoke also supports a bearing assembly 47 for the shaft 38.

A second ratchet 48 is supported around shaft 38 for engagement with a second pawl assembly 50. The later includes pawl 51 and pawl support arm 52 which defines an opening receiving shaft 38 and which is tied thereto by means of screw 53. The ratchet 48 is tied to housing 54 whereby the ratchet will move as this housing rotates about the shaft 38. Each of the pawls is urged against its associated ratchet by means of a torsion spring 56.

Figure 2:
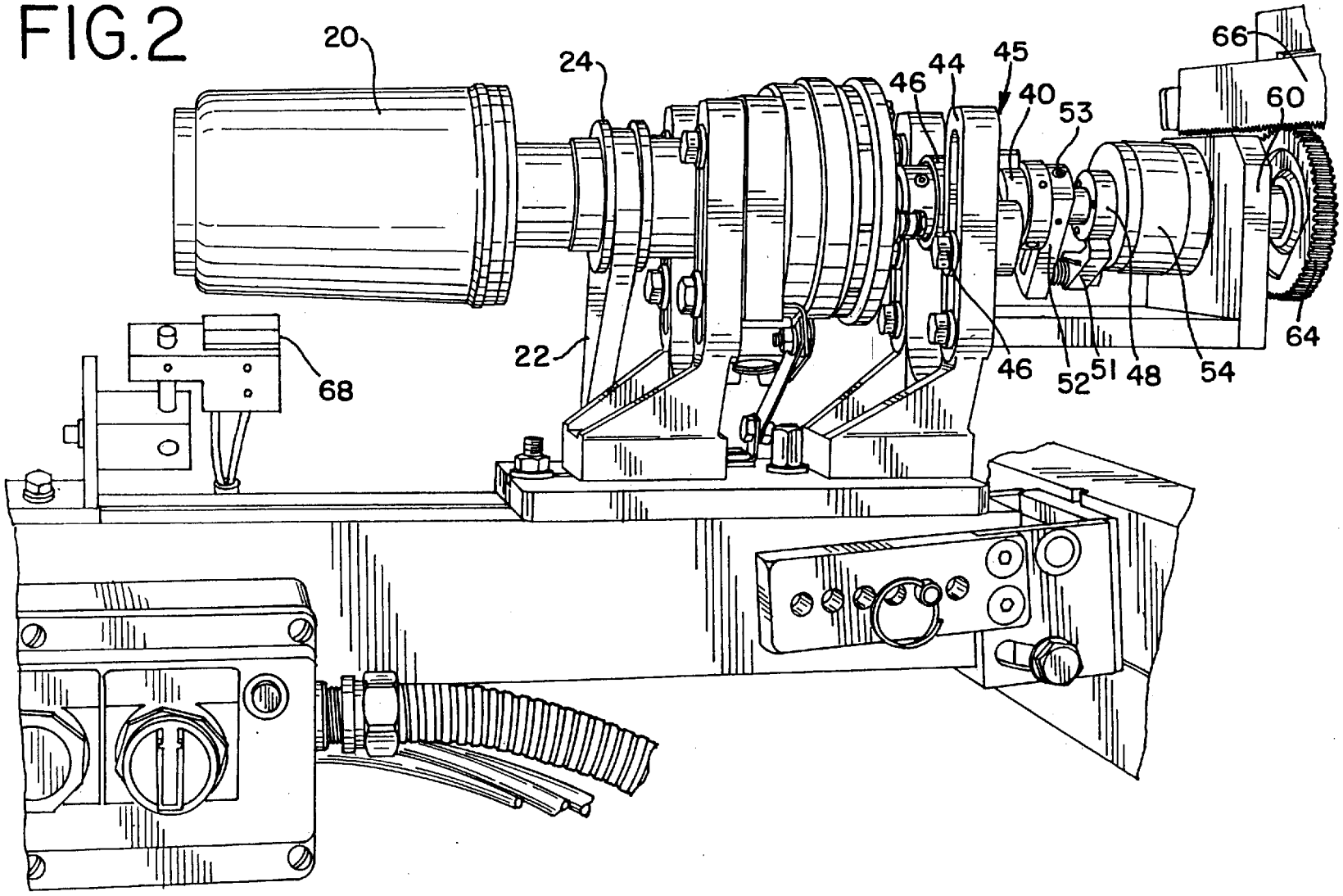
FIG. 2 is an enlarged fragmentary side elevational, perspective, view of the object mounting and drive mechanisms associated with the invention.
Figure 3:
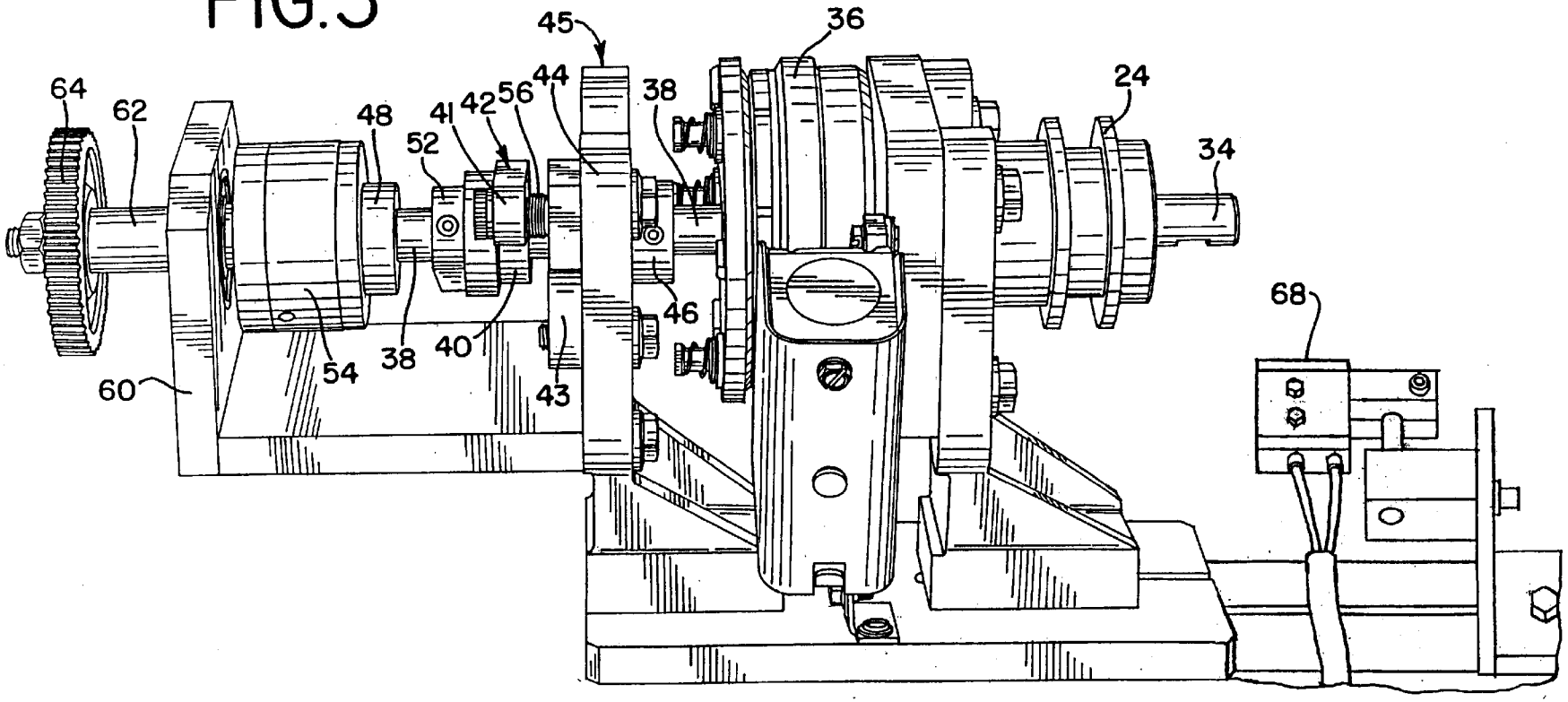
FIG. 3 is an opposite side elevation of the structure shown in FIG. 2.
Figure 6:
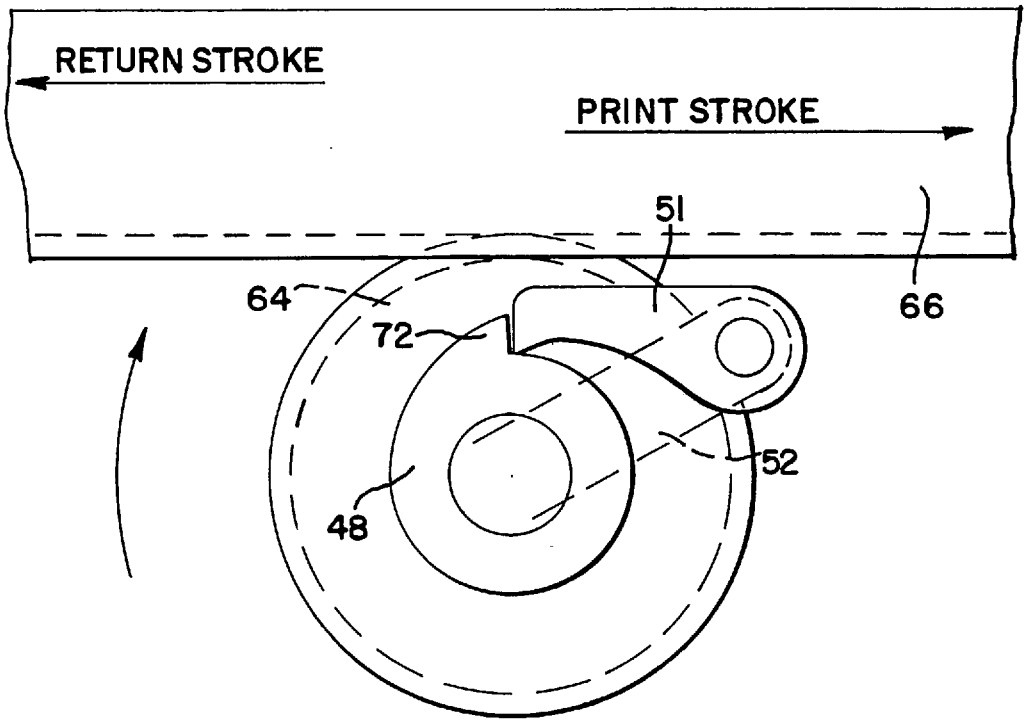
FIG. 6 is a schematic illustration of a second pawl and ratchet means used in the practice of the invention.

A gear carrier 58 is tied to housing 54 for rotation therewith relative to upstanding rear support 60. A rearward extension 62 of the gear carrier has drive gear 64 fixed thereon. As shown in FIGS. 2 and 6, rack 66 is provided for engagement with the gear 64 whereby side-to-side movement of the rack results in rotation of the gear and the associated ratchet 48.

Supported beneath the object 20 is a position sensor 68 which preferably is a photoelectric sensor but could be of any other type in use such as a laser. As is typical in the art, the sensor is adapted to detect a particular mark on the object to be printed. This mark may be a line or other indicia applied to the object prior to printing. As will be apparent when considering the description of the operation, the mark may also be an edge defined by the ink applied to the object as part of the first application step.

The sensor 68 is preferably a color-sensitive sensor which may be obtained from various sources such as Banner Manufacturing or Sick Optics. If, for example, purple is the first color printed, the sensor can be set to pick up this color in preference to other colors printed thereafter. Accordingly, the sensor will function when the object rotates to bring the lead edge of the purple printing into position opposite the sensor and this will be the same position during each printing stage.

The motor 26 employed for driving belt 22 and pulley 24 is a low power motor applying only sufficient force to cause rotation of the object when the movement of shaft 34 is unimpeded. At the start of the printing, the clutch 36 is disengaged so that shaft 34 and the object thereon will rotate in a counterclockwise direction when motor 26 is started.

Eventually, sensor 68 detects a mark on the object 20 and a signal is sent activating clutch 36. Continued rotation of the pulley therefore causes rotation of shaft 38 and associated ratchet 40. This brings the rise 70 of the ratchet into engagement with pawl 41, as shown schematically in FIG. 5, and the pawl thereby prevents further rotation of shafts 34 and 38 and of object 20. Since motor 26 keeps running, but is at low power, the belt will simply slip relative to pulley 24. At the same time, however, the belt is applying a force which holds the ratchet against the pawl thereby maintaining a precise position of the object 20, i.e., object registration.

Either automatically (for example, by virtue of sending a signal when the movement of shaft 38 is interrupted) or manually, the normal printing cycle is then commenced. Thus, rack 66 and associated screen assembly 16 move from right to left to their starting positions, and the screen and squeegee are lowered into position adjacent the object surface. The gear 64 rotates counterclockwise in response to this rack movement and the ratchet 48 also rotates without being impeded by pawl 51.

To initiate printing, the rack 66 is driven left to right and the gear 64 now rotates gear carrier 58, associated housing 54 and ratchet 48 clockwise. Movement of rachet 48 results in engagement of the rise 72 thereon with pawl 51 as shown in FIG. 6. Since the arm 52 supporting pawl 51 is tied to shaft 38, this engagement causes the shaft 38 to be rotated in the clockwise direction which in turn rotates shaft 34 and object 20. The screen movement, being tied to the rack movement in the usual fashion, is thereby synchronized with the movement of the object.

After application of a first color or coating, the object 20 is removed from the machine holding fixture for drying. Thereafter, the object is relocated in the same fixture where the same machine will be used for the successive printing steps, or in the fixture of another machine which has the same mechanical set-up as the first machine. In either event, the photoelectric sensor or the like will detect the indicia on the object and the mechanical operation, through the printing step, will proceed in an identical fashion. Registry of the next color or coating will be automatic.

The provision of the low power motor 26 operating in conjunction with ratchet 40 and pawl 41 is particularly important in insuring highly precise registry. Thus, the motor will constantly urge the ratchet against the pawl and, since the pawl is locked in position on the machine, the ratchet position will always be the same when the printing cycle is started. This feature eliminates the need for a costly electrical brake system to start and stop a variable speed drive motor and/or the need for a second motor to function in this aspect of the operation.

In the preferred operation, it is also important that the ratchet 48, which is tied to housing 54, occupies a specific position relative to the pawl 51 at the end of the movement of rack 66, that is, at the end of each printing operation. This also plays a role in insuring precise registry as the successive printing operations take place.

To illustrate, when the object 20 is returned to the holding fixture, the operator can locate it at any position where subsequent rotation will cause the registry mark to encounter the sensor. Operation of motor 26 will rotate the object whatever distance is necessary for the sensor 68 to detect the indicia on the object and engage clutch 36. If, for example, the rise 70 of ratchet 40 is in the dotted line position shown in Figure S when the clutch engages (which will then be true of each printing step), the ratchet will rotate the distance shown under the influence of motor 26 until engagement with pawl 41 which holds the components in position.

Counterclockwise rotation of the ratchet 48 then occurs as the rack 66 returns to the start position for the next printing. At the end of the rack return movement, the ratchet rise 72 may then occupy the position shown in FIG. 6 (which will then be true for each printing step). Clockwise rotation of shaft 38 due to movement of the rack in the left to right direction for printing will then occur when ratchet rise 72 engages pawl 51.

As indicated, the object movement and coordination with the screen movement is controlled by precise mechanical devices which repeat faithfully successive printing operations. Thus, once the relative ratchet and pawl positions are achieved, superior performance is realized.

Figure 7:
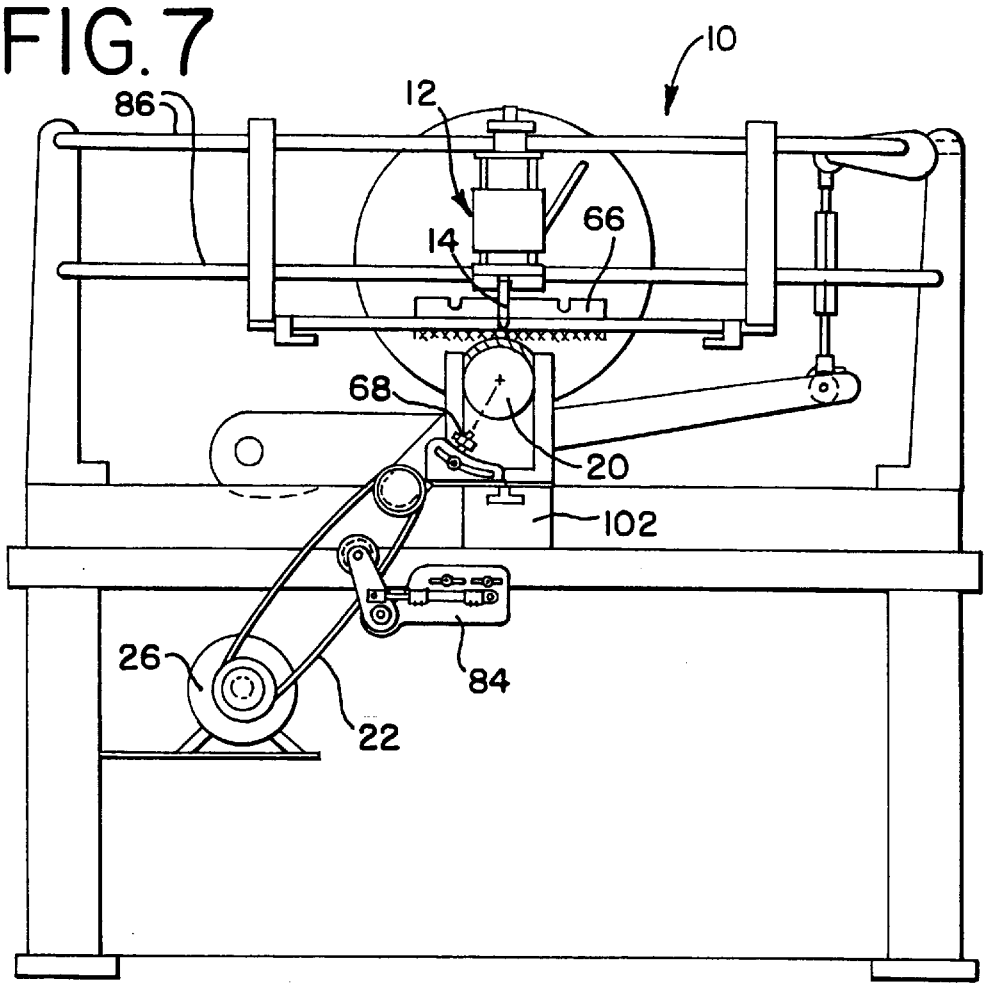
FIG. 7 is a schematic elevational view of a particular form of the invention.
Figure 8:
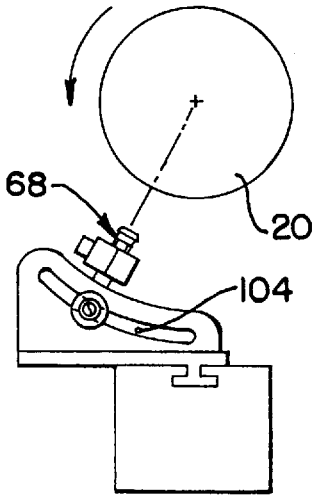
FIG. 8 is a detail view of a photoelectric means used with the invention.

FIGS. 7 and 8 illustrate an example of the invention as applied to equipment described in U.S. Pat. No. 3,090,300. As shown, low power motor 26 drives belt 22. An automatic belt tensioning device 84 is employed to insure that adequate power is transmitted for rotation of the fixture holding object 20. Horizontal supports 86 are provided for gear rack 66 which meshes with gear 64 for controlling screen movement. Squeegee assembly 12 is provided as described in the referenced patent.

As best shown in FIG. 8, color sensor head 68 is fastened onto radial track 104 so that a semi-skilled operator is provided with a simple means for adjusting the registration position without losing the focus length of the sensor head. In this form of the invention, the pre-programmed color is sensed sending an electrical signal through a controller activating the electrical clutch 36 to start the mechanical drive as discussed above.

Figure 9:
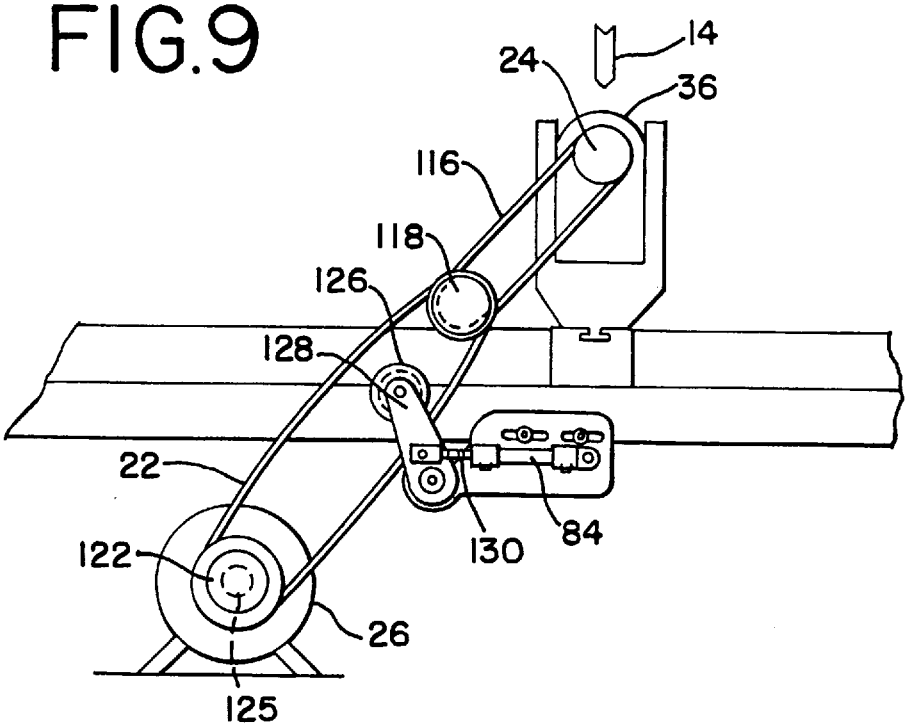
FIG. 9 is a schematic elevational view showing details of a drive means in the disengaged position.
Figure 10:
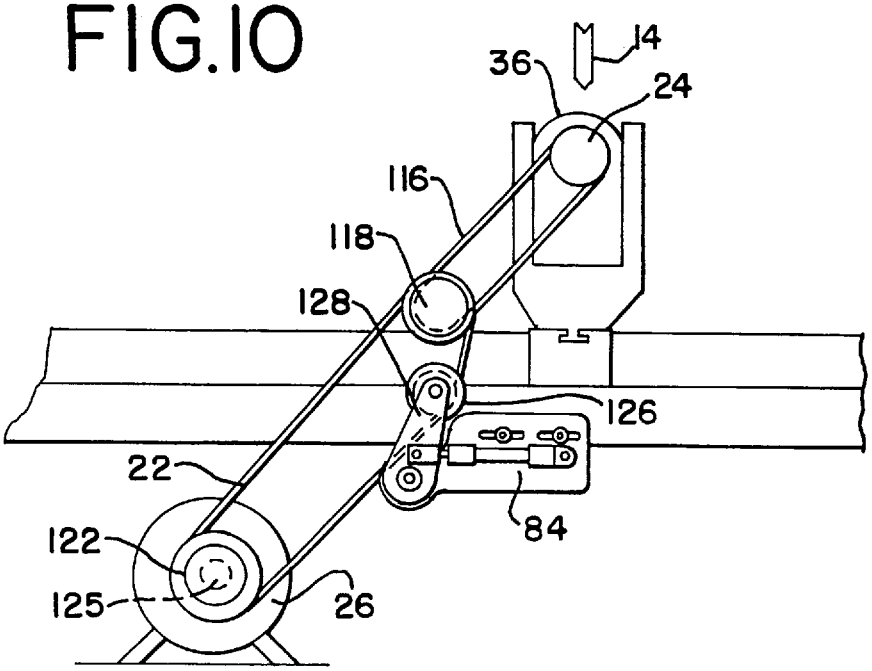
FIG. 10 shows the drive means engaged.

FIGS. 9 and 10 illustrate in greater detail the preferred arrangement for a low power motor used in the system. These drawings show a squeegee 14 and electric clutch 36 operating in the manner described above. Pulley 24 is drivingly connected to a shaft such as shaft 38 when the clutch is activated and this pulley is driven by belt 116 which is under constant tension.

The belt 116 also engages another pulley which is mounted on a common shaft with pulley 118 shown in the drawings. Second belt 22 extends around pulley 118 and also around pulley 122 which is driven by a small variable speed low power motor 26. The latter pulley is connected to the motor through a shaft-mounted adjustable torque slip clutch 125. An object to be printed is mounted on the axis of pulley 24 and rotated with this pulley in response to operation of low power motor 26.

Mounted for engagement with belt 22 is a tensioning pulley 126 supported on pivot arm 128. Solenoid operated piston 130 pivots the arm 128 between the position shown in FIG. 9 where pulley 126 is out of contact with belt 22 and the position of FIG. 10 where the pulley is in contact with this belt. In the former case belt 22 is held loosely on pulleys 118 and 122 whereby operation of motor 26 will not impart a driving force to pulley 118 so that pulley 24 does not rotate and the fixture for holding the object to be printed is held stationary. The pulley 126 is held in this disengaged position when an object is to be installed on or removed from the fixture.

Figure 5:
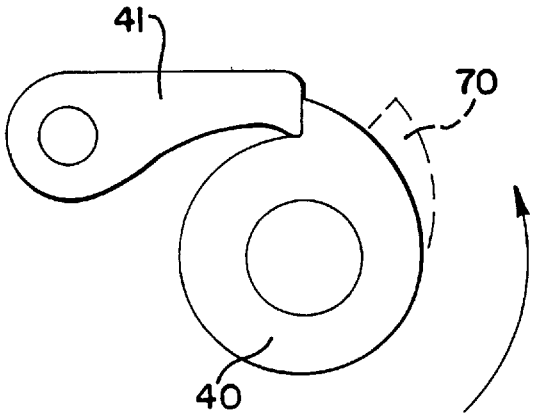
FIG. 5 is a schematic illustration of a first pawl and ratchet means used in the practice of the invention.

When the piston 130 is retracted as shown in FIG. 10, tension is applied to belt 22 and motor 26 will drive the fixture holding the object to be printed. A foot switch or the like may be used after an object has been loaded to initiate a print cycle. As discussed, the object will then rotate until a registration color mark is encountered which engages the electric clutch thereby resulting in positioning of ratchet 40 as shown in FIG. 5. Slip clutch 125 insures continuing application of a slight torque to belt 22 so that the position of ratchet 40 is maintained until the printing cycle starts.

FIG. 11 illustrates schematically an example of an operating sequence utilizing the mechanical drive and registration means of the invention. As shown, rearmost ratchet 48 engages pawl 51 as rack 66 reaches the end of the print stroke. The pawl rides over the surface of the ratchet during return movement.

The return movement preferably involves an intermediate stop position permitting unloading of a printed object and loading of the next object to be printed. When in the stop position, the front ratchet 40 is in the position shown, and when the low power motor 26 is now energized, the ratchet will move into engagement with pawl 41 and be in this position at the end of the return movement of rack 66. The print stroke then commences with rack 66 controlling screen and squeegee movement in conjunction with object rotation.

FIG. 12 shows in diagrammatic form a suitable control system. As shown here and in FIG. 1, switch 70 is used to provide power for motor 26 and a foot pedal is used to operate solenoid value 32 to operate belt tensioner 84. Emergency stop switch 71 is interposed between the pedal and valve. Object rotation occurs when motor 26 and belt tensioner 84 are operating.

Sensor 68 will send information to the color program controller 73 and, when the pre-programmed color is detected, signals are sent to energize clutch 36 and to start the motor controlling rack movement. The print cycle is then achieved and rack movement then continues to the stop position where a limit switch operates to shut off the main motor and deactivate tensioner solenoid 32.

Jog set-up switch 72 is used in conventional fashion to coordinate the registration and mechanical drive operations when preparing the equipment for a new job.

It will be understood that various changes and modifications may be made in the system of the invention without departing from the sprint thereof particularly as defined by the following claims.

That which is claimed:

1. A screen printing apparatus comprising a fixture for rotatably supporting an object to be printed, a screen, means for moving the object and screen to achieve contact between the screen and object surface, and a squeegee for contacting the screen to force printing material through openings in the screen for application to the object surface, a first rotatable shaft connected to said fixture, a second rotatable shaft, clutch means connecting said shafts for engaging and disengaging driving action therebetween, a first ratchet mounted on said second shaft for rotation therewith, a first pawl located in a fixed position adjacent said second shaft and engageable with said first ratchet to restrict rotation of the second shaft in one direction while permitting rotation of the second shaft in the opposite direction, a second ratchet mounted adjacent said second shaft, a second pawl mounted on said second shaft and engageable with said second ratchet whereby rotation of said second ratchet in said opposite direction operates to rotate said second shaft, means for detecting a registration mark on said object to be printed, and means for engaging said clutch means in response to detection of a registration mark.

2. An apparatus according to claim 1 wherein said clutch means is an electromagnetic clutch, said means for detecting operating to send an electrical signal to said clutch.

3. An apparatus according to claim 2 wherein said detecting means comprises a color sensitive means, and means for adjustably mounting said detecting means relative to said fixture.

4. An apparatus according to claim 1 including a motor for driving said first shaft, and means for interrupting the driving of said first shaft to permit loading and unloading of an object relative to said fixture.

5. An apparatus according to claim 4 including a belt and pulley drive connecting said motor to said fixture, and belt tensioning means for engaging and disengaging the driving of said first shaft by said motor.

6. An apparatus according to claim 1 including a motor for driving said first shaft, said motor continuing to apply torque to said first shaft after said clutch is engaged and after said first pawl restricts movement of said second shaft.

7. An apparatus according to claim 6 including a torque slip clutch between said motor and said first shaft.

8. An apparatus according to claim 1 including means for reciprocally driving said screen between a print end position and a print start position, a one-way clutch connecting said screen to said second shaft, said clutch permitting movement of said screen from said print end position to said print start position while movement of said second shaft is restricted by said first pawl, and said one-way clutch providing a drive connection between said screen and said second shaft when the screen is moved from the print start to the print end position.

9. An apparatus according to claim 8 wherein the drive connection provided by the one-way clutch drives said second ratchet into engagement with said second pawl.

* * * * *